US005405052A

United States Patent [19]

Sawyer, III

[11] Patent Number: 5,405,052

[45] Date of Patent: Apr. 11, 1995

[54] BOTTLED-WATER DISPENSER WITH ICE MAKER AND COOLER

[76] Inventor: Miles G. Sawyer, III, P.O. Box 578, Carrboro, N.C. 27510

[21] Appl. No.: 164,415

[22] Filed: Dec. 9, 1993

[51] Int. Cl.[6] ..... B67D 5/08

[52] U.S. Cl. ..... 222/64; 222/146.6; 222/413; 62/340

[58] Field of Search ..... 222/56, 64, 146.6, 185, 222/240, 413; 62/137, 340, 390, 391

[56] References Cited

U.S. PATENT DOCUMENTS

| | | | |
|---|---|---|---|
| 3,796,063 | 3/1974 | Wulke et al. | 62/340 |
| 3,908,391 | 9/1975 | Wulke et al. | 62/137 |
| 3,983,583 | 10/1976 | Herman et al. | 62/340 |
| 4,207,994 | 6/1980 | Offlec, Sr. | 222/146.6 |
| 4,815,941 | 3/1989 | Fayo | 62/340 |
| 4,939,816 | 7/1990 | Schenkel et al. | 222/56 |
| 5,050,777 | 9/1991 | Buchser | 222/146.6 |
| 5,112,477 | 5/1992 | Hamlin | 222/146.6 |
| 5,212,957 | 5/1993 | Ruff | 62/137 |
| 5,297,401 | 3/1994 | Hawco | 62/340 |

FOREIGN PATENT DOCUMENTS

| | | | |
|---|---|---|---|
| 1276060 | 8/1968 | Germany | 222/146.6 |
| 5-332653 | 12/1993 | Japan | 62/391 |

*Primary Examiner*—Andres Kashnikow
*Assistant Examiner*—Philippe Derakshani
*Attorney, Agent, or Firm*—Rhodes, Coats & Bennett

[57] ABSTRACT

A bottled-water dispenser is capable of dispensing either cold water or ice made from purified bottled water. The bottled-water dispenser includes a cabinet having a cooling compartment and a freezer compartment. The cooling compartment is maintained above the freezing point of water. The freezer compartment is maintained below the freezing point of water. A water reservoir is mounted in the cooling compartment and receives water from an inverted water bottle mounted on top of the cabinet. The ice maker and water dispensing valves are connected by water supply lines to the reservoir. The ice maker unit includes a discharge assistant for discharging ice from a storage bin. The discharge assistant and water solenoid are activated by dispensing levers disposed on the front of the cabinet. By pressing a glass against the dispensing levers, either cold water or ice is dispensed.

10 Claims, 3 Drawing Sheets

BOTTLED-WATER DISPENSER WITH ICE MAKER AND COOLER

FIELD OF THE INVENTION

The present invention relates generally to bottled-water dispensers for dispensing purified water, and more particularly to a bottled-water dispenser having an ice maker for making ice from purified bottled water.

BACKGROUND OF THE INVENTION

Bottled-water dispensers capable of dispensing cold water have been commercially available for many years. Typically, a bottled-water dispenser includes a cabinet having a reservoir to receive purified water. A bottle containing purified water is disposed on the top of the cabinet in an inverted position so that the neck of the bottle extends into the reservoir. The purified water flows under the force of gravity into the water reservoir.

Many bottled-water dispensers include a refrigerator system for cooling the water contained in the reservoir. The refrigerator system normally maintains the temperature of the water above the freezing point to provide cold water. In the past, bottled-water dispensers have not been provided with an ice maker for making ice from purified water. While many refrigerators include ice makers for making ice, the refrigerator units are usually connected to a source of tap water which is not purified. Thus, persons who drink purified bottled water must choose between drinking purified water without ice or using ice made from unpurified tap water.

In the past, it has been proposed to interconnect a pump between a bottled-water dispenser and an ice maker of a conventional refrigerator. Examples of such systems are disclosed in U.S. Pat. Nos. 4,207,994 to Ofley, Sr., and 4,815,941 to Fao. However, these devices have limited utilities Since it can be used only where a conventional refrigerator is available. Further, the cost of the pump for transferring water between the bottled-water dispenser and the refrigerator unit makes the cost of such systems prohibitive.

Accordingly, there is a need for a bottled-water dispenser having an ice maker for making ice from purified bottled water.

SUMMARY AND OBJECTS OF THE INVENTION

The present invention is a bottled-water dispenser which is capable of dispensing cold water or ice made from purified bottled water. The dispenser includes a cabinet having a cooling compartment and a freezer compartment. A water reservoir is disposed in the cooling compartment for receiving purified water. A bottle containing the purified water is mounted in an inverted position on top of the cabinet and empties into the water reservoir. An ice maker is disposed within the freezer compartment and is connected to the water reservoir. Water flows from the reservoir to the ice maker and to a water dispensing solenoid.

A pair of dispensing levers are mounted on the front of the cabinet for dispensing cold water and ice respectively. The water dispensing lever energizes the water solenoid in the water line to dispense cold water from the reservoir. The ice dispensing lever activates an ice auger to automatically deliver ice through a chute in the cabinet. An ice crusher may be provided for crushing the ice.

Based on the foregoing, it is a primary object of the present invention to provide a bottled-water dispenser capable of separately dispensing chilled and purified water or ice made from purified water.

It is another object of the present invention to provide a bottled-water dispenser having a self-contained ice maker for making ice from purified bottled water.

Another object of the present invention is to provide a bottled-water dispenser which is relatively inexpensive to produce.

DETAILED DESCRIPTION OF THE INVENTION

Figure 1:
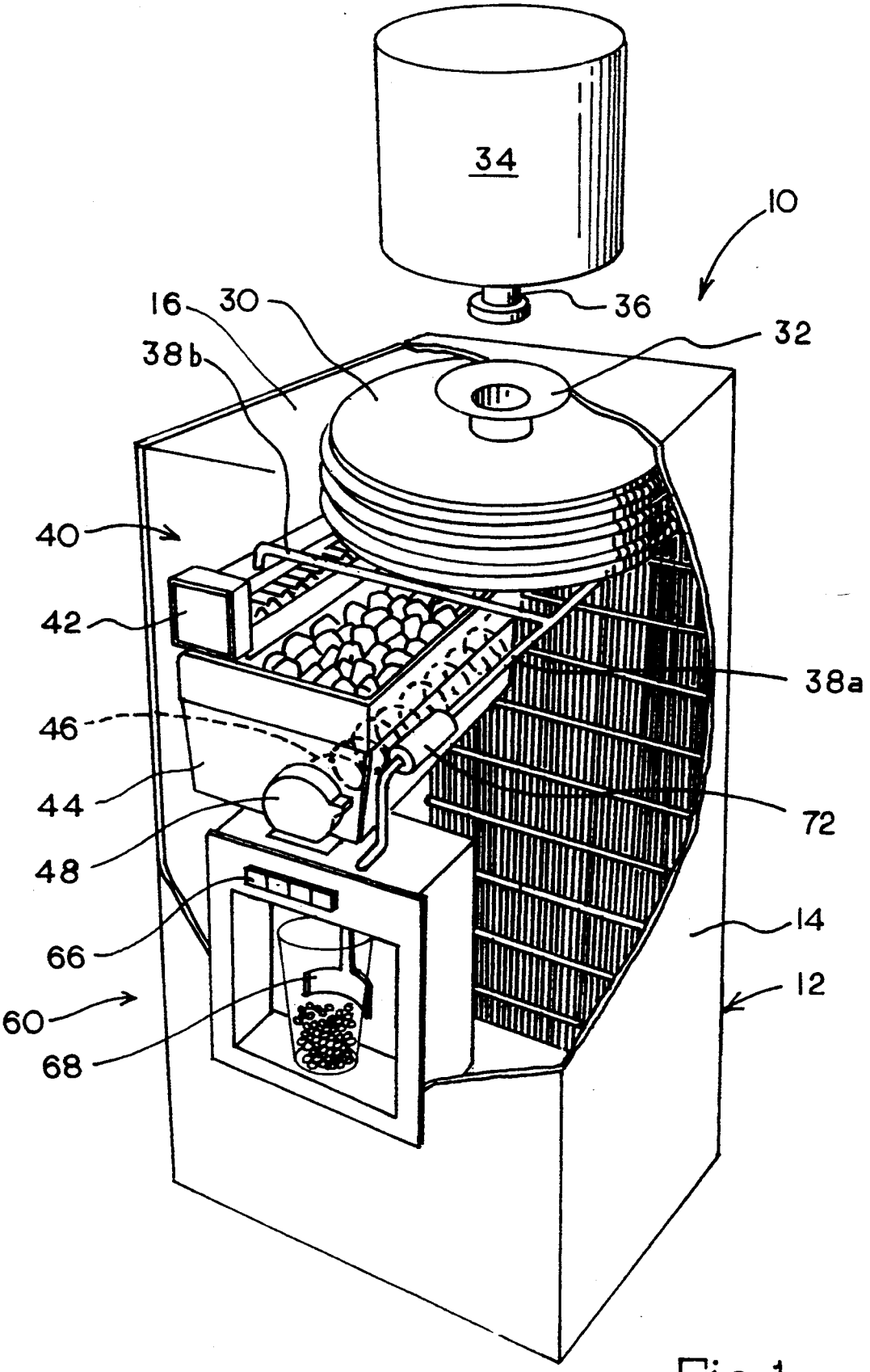
FIG. 1 is a schematic perspective view of the bottled-water dispenser.

Referring now to the drawings, and particularly to FIG. 1, the bottled-water dispenser of the present invention is shown therein and indicated generally by the numeral 10. The bottled-water dispenser 10 includes a free-standing cabinet 12. The cabinet 12 contains a refrigeration system (not shown) for cooling the interior of the cabinet. The interior of the cabinet 12 must be cooled below the freezing point of water so that ice can be formed.

A water reservoir 30 is disposed near the top of the cabinet 12. The water reservoir is insulated to prevent the water contained therein from freezing. The water reservoir 30 has a top opening 32 which receives the neck 36 of an inverted water bottle 34. The water bottle 34 typically contains purified water. The purified water from the water bottle 34 flows by gravity from the water bottle 34 into the reservoir 30 where it is cooled. The water reservoir 30 is connected by water supply lines 38*a* and 38*b* to a water solenoid 72 and ice maker assembly 40. Water supply lines 38*a* and 38*b* are also insulated.

The ice maker assembly 40 is disposed in the cabinet 12. The ice maker assembly 40 comprises a conventional ice maker 42. The ice maker 42 is connected to the water reservoir 30 by water supply line 38*b*. Supply line 38*b* is insulated to prevent freeze-up of the water in the supply line 38*b*. The ice maker 42 is operative to make ice in a manner well known to those skilled in the art.

A storage bin 44 is disposed below the ice maker 42. Ice from the ice maker 42 is dumped into the storage bin 44. A discharge device is disposed in the storage bin 44 to dispense ice from the storage bin 44. In the illustrated embodiment, the discharge device comprises a motor-driven ice auger 46 which moves ice forwardly in the storage bin 44 as the ice auger 46 rotates. The ice auger 44 draws the ice into an ice crusher 48 mounted on the front of the storage bin 44. If the ice crusher 48 is activated, the ice is crushed as it is delivered to the dispenser assembly 60.

Figure 2A:
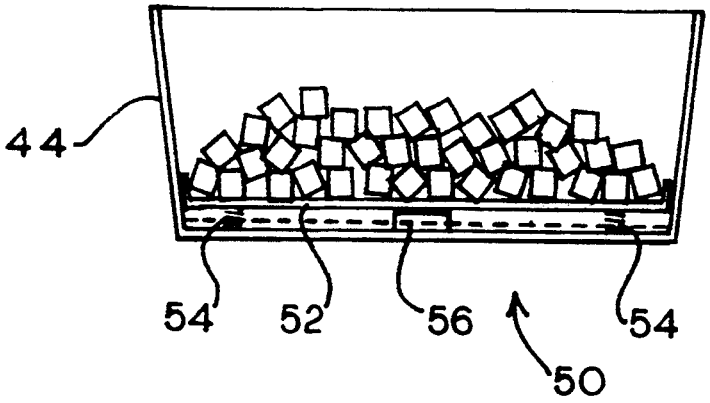
FIG. 2*a* is a section view of an ice storage bin.

As ice accumulates in the storage bin 44, it is necessary to temporarily shut off the ice maker 42. A sensing means 50 is used to sense when the storage bin 44 is full. The sensing means 50 may take a variety of forms. In FIG. 2*a*, the sensing means 50 comprises a sensor 56 which is activated by the weight of the ice in the storage bin 44. The storage bin 44 is provided with a false bottom 52 which is supported by springs 54. As ice accumulates in the storage bin 44, the weight of the ice presses the false bottom 52 downwardly to activate a sensor 56 which shuts off the ice maker 42.

Figure 2B:
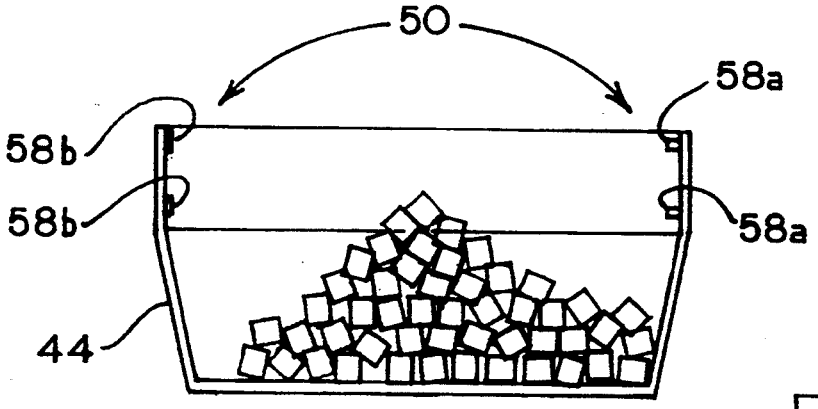
FIG. 2*b* is a section view of an alternate embodiment of an ice storage bin.

FIG. 2*b* shows an alternate embodiment of the sensing means 50. In FIG. 2*b*, the sensing means comprises a pair of sensors each of which includes a light-emitting unit 58*a* and a reflector 58*b*. When the ice accumulates in the storage bin 44 to the level of the top sensor, the ice maker 42 is deactivated. When the ice drops below the level of the bottom sensor, the ice maker 42 is restarted. Thus, the sensors 58 maintain the level of the ice between the bottom sensor and top sensor.

The dispenser assembly 60 comprises a recessed dispensing panel 62 disposed in the front of the cabinet 12. The dispensing panel 62 is formed with an ice chute 64 in the top thereof which is disposed immediately below the ice crusher 48. A selector switch 66 is mounted on the dispenser panel 62 for selecting either water, crushed ice, or cubed iced. If water is selected, pressing dispensing lever 68 actuates water solenoid 72 to dispense water. If "cubed ice" is selected, dispensing lever activates the ice auger 46 to dispense ice. If "crushed ice" is selected, dispensing lever activates both the ice auger 46 and ice crusher 48 to crush the ice as it is dispensed.

Figure 3:
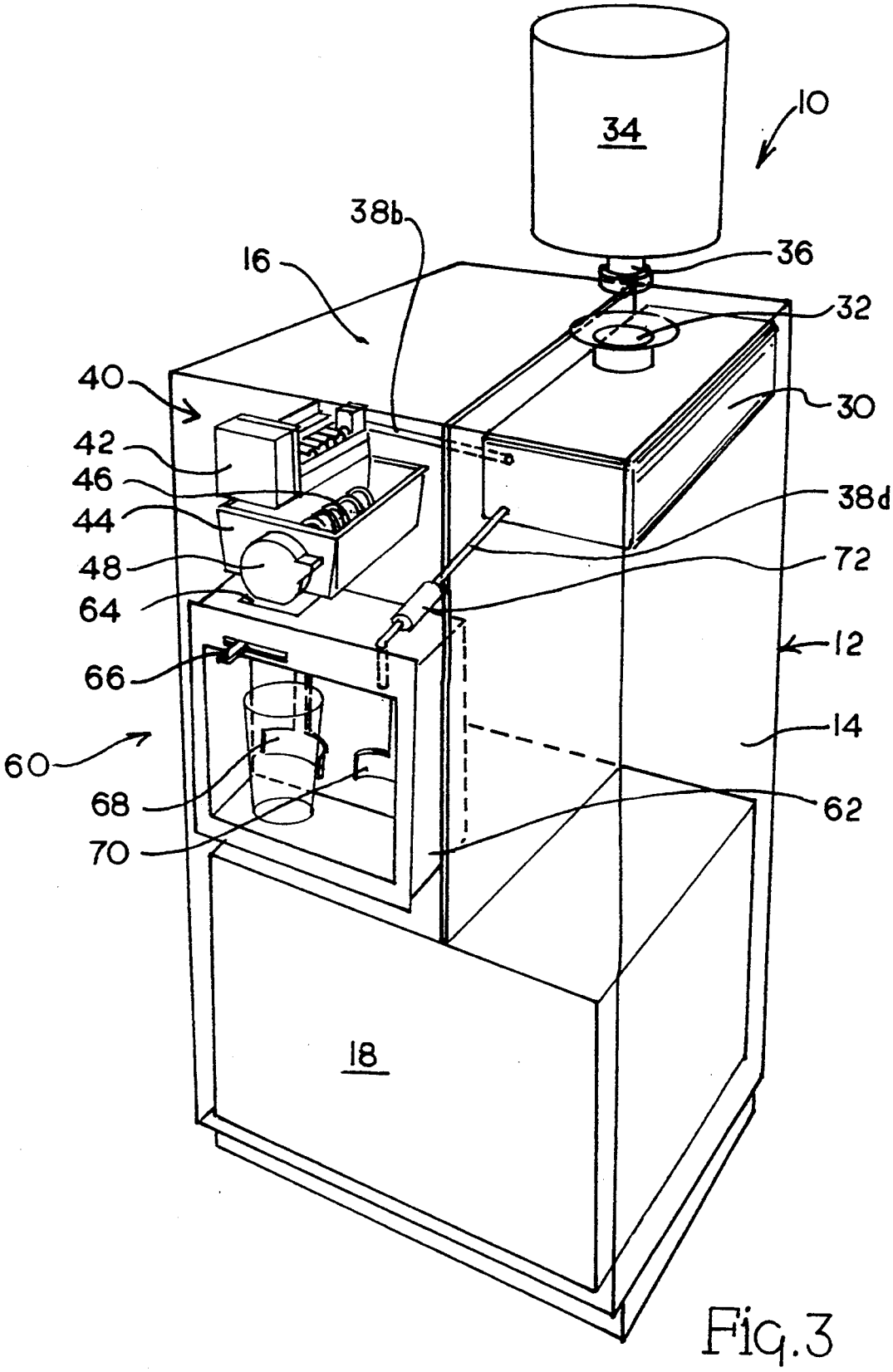
FIG. 3 is a schematic view of an alternate embodiment of the bottled-water dispenser.

FIG. 3 shows an alternate embodiment of the present invention. The embodiment shown in FIG. 3 is similar to the first embodiment except as follows.

In the embodiment shown in FIG. 3, the cabinet 12 is divided into two discrete compartments - a cooling compartment 14 and freezer compartment 16. The cooling compartment 14 and freezer compartment 16 are insulated. The water reservoir 30 is disposed in the cooling compartment 14 while the ice maker 42 is disposed in the freezer compartment 16.

A refrigerator unit 18 is disposed in the bottom portion of the cabinet 12. The refrigerator unit 18 is operative to cool the cooling compartment 12 and freezer compartment 16. Individual thermostats control the temperature of the cooling compartment 14 and freezer compartment 16. The cooling compartment 14 is maintained above the freezing point of water, preferably about 45°. The freezer compartment is maintained below the freezing point of water, preferably about 25° F.

The dispensing assembly 60 also differs slightly from the first embodiment. In the embodiment shown in FIG. 3, the dispensing assembly 60 includes two dispensing levers 68 and 70. Dispensing lever 68 controls the dispensing of ice while dispensing lever 70 can cause the dispensing of water. A glass is pressed against the dispensing lever 68 to activate the ice auger 48 and deliver ice to the glass. If the ice selector switch 66 is in the "crushed ice" position, the ice crusher 50 is also activated to crush the ice. If the ice selector switch 66 is in the "cubed ice" position, the ice crusher 50 is deactivated.

The water dispensing lever 70 energizes the water line solenoid 72 in water supply line 38*a*. When a glass is pressed against the water dispensing lever 70, solenoid 72 is activated to dispense cold water from the reservoir 30 into the glass. The water is forced by gravity through the water line 38*a* to the spout.

The bottled-water dispenser 10 described is capable of dispensing cold water or ice made from purified water. Thus, the bottled-water dispenser 10 eliminates the need to use ice made from tap water. Further the present invention eliminates the need to connect a conventional bottled-water dispenser to a separate refrigerator unit.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A bottled-water dispenser for dispensing cold water or ice comprising:

(a) a cabinet;

(b) a container mounted on said cabinet for containing purified water;

(c) a water reservoir disposed in the cabinet for receiving purified water from said container;

(d) a water dispensing valve connected to the water reservoir for dispensing purified water from the water reservoir;

(e) an ice maker unit disposed in the cabinet and connected to said water reservoir for making ice from the purified water in said reservoir;

(f) a storage bin for storing the ice made from the purified water;

(g) a discharge assistant for discharging ice from the storage bin;

(h) activating means for selectively activating the water dispensing valve and the discharge assistant to selectively dispense either cold water or ice and;

(i) wherein said water dispensing valve and said ice maker unit are disposed below said water reservoir such that the purified water flows by gravity from said water reservoir to the ice maker unit and water dispensing valve without the aid of a pump.

2. The apparatus of claim 1 further including an ice crusher for crushing ice dispensed.

3. The bottled-water dispenser of claim 2 further including an ice selector switch for selectively activating the ice crusher when ice is dispensed.

4. The bottled-water dispenser of claim 1 further including shut-off means for shutting off the ice maker.

5. The bottled-water dispenser of claim 4 wherein the shut-off means includes sensing means for sensing the amount of ice in the storage bin and shutting off the ice maker when the storage bin is full.

6. The bottled-water dispenser of claim 5 wherein the sensing means comprises at least one light sensor disposed in an upper portion of the storage bin.

7. The bottled-water dispenser of claim 5 wherein the sensing means comprises a weight sensor for sensing the weight of the ice in the storage bin.

8. The bottled-water dispenser of claim 1 wherein said container is a water bottle disposed in an inverted position on the top of the cabinet.

9. The bottled-water dispenser of claim 9 wherein the water bottle includes a neck extending into the water reservoir.

10. The bottled-water dispenser of claim 1 wherein said cabinet includes a cooling compartment containing the water reservoir, and a freezer compartment containing the ice-maker assembly.

* * * * *

UNITED STATES PATENT AND TRADEMARK OFFICE

CERTIFICATE OF CORRECTION

PATENT NO. : 5,405,052

DATED : April 11, 1995

INVENTOR(S) : Miles G. Sawyer, III

It is certified that error appears in the above-identified patent and that said Letters Patent is hereby corrected as shown below:

On the title page, item: [54], and column 1, line 2.

In the Title, the word "Cooler" should be changed to "Crusher".

Signed and Sealed this

Twelfth Day of September, 1995

*Attest:*

Bruce Lehman

BRUCE LEHMAN

*Attesting Officer*

*Commissioner of Patents and Trademarks*